US006781302B2

(12) United States Patent
Sigai et al.

(10) Patent No.: US 6,781,302 B2
(45) Date of Patent: Aug. 24, 2004

(54) LOW PRESSURE MERCURY VAPOR FLUORESCENT LAMPS

(75) Inventors: Gary A. Sigai, Salina, KS (US); Snehasish S. Ghosh, Seattle, WA (US); David Curtis Nesting, Salina, KS (US); Brett A. Carter, Salina, KS (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 15 days.

(21) Appl. No.: 10/259,713

(22) Filed: Sep. 27, 2002

(65) Prior Publication Data

US 2004/0061428 A1 Apr. 1, 2004

(51) Int. Cl.[7] ..... H01J 1/32; H01J 17/16

(52) U.S. Cl. ..... 313/486; 313/485; 313/635; 252/301.4 R; 252/301.4 P

(58) Field of Search ..... 313/486, 487, 313/485, 493, 634, 635

(56) References Cited

U.S. PATENT DOCUMENTS

| | | | | |
|---|---|---|---|---|
| 2,488,733 A | | 11/1949 | Mc Keag et al. | |
| 4,079,287 A | | 3/1978 | Soules et al. | |
| 4,698,548 A | * | 10/1987 | Chenot et al. | 313/487 |
| 4,871,944 A | | 10/1989 | Skwirut et al. | |
| 5,447,660 A | | 9/1995 | Chau | |
| 6,528,938 B1 | * | 3/2003 | Jansma | 313/485 |
| 6,583,543 B1 | * | 6/2003 | Itaya et al. | 313/113 |

FOREIGN PATENT DOCUMENTS

| | | |
|---|---|---|
| EP | 0239924 A2 | 10/1987 |
| EP | 0257554 A2 | 3/1988 |

* cited by examiner

*Primary Examiner*—Ashok Patel
*Assistant Examiner*—German Colón
(74) *Attorney, Agent, or Firm*—Ernestine C. Bartlett

(57) ABSTRACT

A low mercury consumption electric lamp is provided having a a layer of a luminescent material comprising a phosphor derived from a mixture of a blue-halo calcium halophosphate phosphor having an average particle size within the range of about 6.6 to about 10 microns; a calcium-yellow calcium halophosphate phosphor having an average particle size within the range of about 9.0 to about 13 microns; and fines of a warm-white calcium halophosphate phosphor, preferably having an average particle size of about 4.62.

19 Claims, 2 Drawing Sheets

LOW PRESSURE MERCURY VAPOR FLUORESCENT LAMPS

RELATED APPLICATION

This application is related to U.S. application Ser. No. 10/179,365, filed Jun. 24, 2002, of Gary Sigai and Snehasish Ghosh, "Low Pressure Mercury Vapor Fluorescent Lamps", and commonly assigned herewith, the disclosure of which is incorporated by reference.

FIELD OF THE INVENTION

This invention relates to low-pressure mercury vapor fluorescent lamps.

BACKGROUND OF THE INVENTION

Low pressure mercury vapor lamps, more commonly known as fluorescent lamps, have a lamp envelope with a filling of mercury and rare gas to maintain a gas discharge during operation. The radiation emitted by the gas discharge is mostly in the ultraviolet (UV) region of the spectrum, with only a small portion in the visible spectrum. The inner surface of the lamp envelope has a luminescent coating, often a blend of phosphors, which emits visible light when impinged by the ultraviolet radiation.

There is an increase in the use of fluorescent lamps because of reduced consumption of electricity. To further reduce electricity consumption, there is a drive to increase efficiency of fluorescent lamps, referred to as luminous efficacy which is a measure of the useful light output in relation to the energy input to the lamp, in lumens per watt (LPW).

Thus, more efficient and longer life fluorescent lamps are desired. However, a significant excess of mercury is introduced into the lamp to meet desired long lamp lifetime of up to 20,000 hours or more. This is necessary because different lamp components, such as the glass envelope, phosphor coatings and electrodes use up the mercury in the lamp. Such increased use of mercury is not desirable and is detrimental to the environment. Accordingly, there is a drive to reduce mercury consumption in fluorescent lamps without a reduction in the lamp life.

An example of a successful lamp with reduced mercury consumption is the Alto Econowatt fluorescent lamp. These lamps use large-particle cool-white calcium halophosphate phosphor having an average particle size of about 12 to 16 microns and are doped with less mercury than other lamps to meet the TCLP requirement for non-hazardous waste. To continue to meet the rated life of these lamps, it is essential that the lamp and its components have low mercury consumption.

Similarly, fluorescent lamps of Daylight/Daylight Deluxe color have used a large-particle blue-halo calcium halophosphate phosphor as part of a two-component blend that uses a standard white phosphor or a warm-white phosphor as the other component. These lamps are doped with less mercury to meet the TCLP requirement for non-hazardous waste.

There is a continued need for fluorescent lamps with reduced mercury that pass the TCLP standards.

SUMMARY OF THE INVENTION

An object of the present invention is to provide fluorescent lamps of cool-white color with reduced mercury consumption.

Another object of the invention is to provide phosphor blends that are useful in the manufacture of such fluorescent lamps of cool-white color with reduced mercury consumption.

The present invention accomplishes the above and other objects by providing an electric lamp having an envelope with an inner surface and at least one electrode, preferably electrodes located at both ends of the envelope tube. The lamp may be a straight fluorescent tube, for example of the type as illustrated in the embodiment of the invention shown in FIG. 1 such as T12 straight Econowatt lamps, or it may be a lamp that includes an envelope of convoluted configuration to a desired shape such as an envelope having at least two straight leg segments joined by a U-bent section as illustrated in the embodiment of the invention shown schematically in FIG. 2 or as in PL lamps, Circleline lamps, SLS lamps, etc. In either embodiment, the electrodes transfer electric power to generate ultraviolet radiation in the envelope which is filled with mercury and a charge sustaining gas.

Optionally, as in the case of the straight envelope fluorescent lamps, the inner surface of the envelope may be pre-coated with a metal oxide layer, such as an aluminum oxide layer, to reflect ultraviolet radiation back into the envelope. Such pre-coats are not customarily used in the case of lamps with convoluted envelopes although a flexible pre-coat may be used in the case of SLS lamps as mentioned further hereinbelow.

A phosphor layer is formed over the inner surface, pre-coated or not, to convert the ultraviolet radiation to visible light. In conventional lamps, the phosphor layer for a conventional F34T12 straight Econowatt fluorescent lamp is preferably a large particle-sized cool-white calcium halophosphate phosphor formed from a coating which comprises calcium halophosphate activated with manganese and antimony. Similarly the phosphor layer for a conventional U-bend fluorescent lamp of cool-white color contains a large particle-sized two phosphor mix of about 50% large particle cool-white calcium halophosphate activated with antimony and manganese, and about 50% fines of cool-white calcium halophosphate activated with manganese and antimony. The fines are normally used to achieve good adhesion particularly in the convoluted or bent areas between the glass layer or coatings thereon and the phosphor layer.

We have discovered that the color obtained from the conventional large particle phosphor blend can be achieved by a phosphor derived from a mixture of fines of warm-white calcium halophosphate phosphor, small-particle blue-halo calcium halophosphate phosphor, and calcium-yellow calcium halophosphate phosphor. It has been found further that using this phosphor blend makes it possible to achieve good adhesion in the manufacture of convoluted lamps of the U-bend type while using low mercury doses in the fluorescent lamp making it environmentally benign.

In preferred embodiments of the invention, a cool-white U-bend fluorescent lamp is provided having a phosphor that comprises a mixture of (1) a blue-halo calcium halophosphate phosphor having an average particle size within the range of about 6.6 to about 10 microns, most preferably having an average particle size of about 8.60 microns in a mixture comprising about 18% of the blue-halo calcium halophosphate phosphor;

(2) a calcium-yellow calcium halophosphate phosphor having an average particle size within the range of about 9.0 to about 13 microns, most preferably having an average particle size of about 11.3 microns in a mixture comprising about 41% of the calcium-yellow calcium halophosphate phosphor; and (3) fines of a warm-white calcium halophosphate phosphor of randomly occurring particle size, most preferably having an average particle size of about 4.62 microns in a mixture comprising about 41% of the warm-white phosphor.

Such phosphor blends result in low-mercury consuming lamps. permit use of reduced amounts of mercury when compared to commercially available lamps (other than the Philips Alto lamps) produced with the large particle phosphors in which more mercury is required.

Mercury consumption is determined by the quantity of mercury which is bound on lamp components during operation of the lamp and is thus no longer available for operation of the lamp. In the present invention, it is possible to have reduced amounts of mercury doped in fluorescent lamps and preferably in cool-white U-bend fluorescent lamps, making such lamps environmentally benign and TCLP compliant.

Lamps derived from such phosphors of the invention also exhibit excellent long-life characteristics.

While the exact reasons for such observations are not known with certainty and we do not wish to be bound by any particular theory, it is believed that due to the small particle size of the warm-white fines and of the blue-halo phosphor, the phosphor of the invention provides good packing of the grains of the phosphor coating on the lamp and good shielding of the glass providing an improved barrier that reduces mercury loss in glass.

In lamps of the invention, the initial dose of elemental mercury is provided in such a quantity that:

(A) after about 2,500 hours of lamp operation a sufficient quantity of elemental mercury is available to support a column discharge, and (B) said lamp is TCLP standard compliant.

This is a real advantage, since the lamps pass the TCLP test through actual reduction in the amount of mercury in the lamp.

Thus the invention in preferred embodiments encompasses an electric lamp which comprises:

a lamp envelope having an inner surface;

means within the lamp envelope for generating ultraviolet radiation; and a layer of a luminescent material that includes a phosphor derived from a mixture of:

(1) a blue-halo phosphor having an average particle size within the range of about 6.6 to about 10 microns, most preferably having an average particle size of about 8.60 microns in a mixture comprising about 18% of the blue-halo phosphor;

(2) a calcium-yellow phosphor having an average particle size within the range of about 9.0 to about 13 microns, most preferably having an average particle size of about 11.3 microns in a mixture comprising about 41% of the calcium-yellow phosphor; and (3) fines of a warm-white phosphor of randomly occurring particle size, most preferably having an average particle size of about 4.62 microns, in a mixture comprising about 41% of the warm-white phosphor.

The figures are diagrammatic and not to scale.

The invention will be better understood with reference to the details of specific embodiments that follow:

DETAILED DESCRIPTION OF THE PREFERRED EMBODIMENTS

Figure 1:
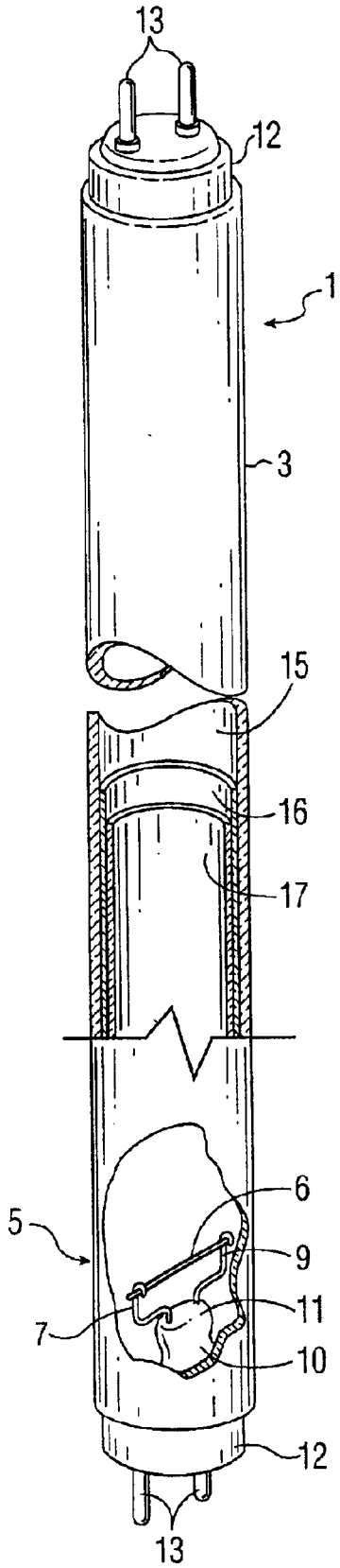
FIG. 1 is a perspective view of one embodiment of a fluorescent lamp according to the invention, partly in cross-section, partly broken away.

With reference to FIG. 1, there is illustrated a low pressure mercury vapor fluorescent lamp 1 with an elongated, straight lamp vessel, or bulb, 3. The bulb is of a conventional soda-lime glass. The lamp includes an electrode mount structure 5 at each end which includes a coiled tungsten filament 6 supported on conductive feed-throughs 7 and 9 which extend through a glass press seal 11 in a mount stem 10. The mount stem is of a conventional lead-containing glass. The stem 10 seals the envelope in a gas tight manner. The leads 7, 9 are connected to the pin-shaped contacts 13 of their respective bases 12 fixed at opposite ends of the lamp.

Optionally, the inner surface 15 of the outer envelope 3 is provided with a mercury-protective layer or undercoat 16. The layer 16 may be provided to reduce the rate of mercury depletion caused by reactions with the glass of the envelope. The layer 16 may be an oxide formed from the group consisting of magnesium, aluminum, titanium, zirconium and the rare earths. As used herein, the term "rare earths" means the elements scandium, yttrium, lanthanum and the lanthanides. Both coatings extend the full length of the bulb, completely circumferentially around the bulb inner wall. The stems 10 are free of any of the above coatings. A phosphor coating 17 is disposed over the overcoat layer 16.

The discharge-sustaining filling includes an inert gas such as argon, or a mixture of argon and other gases, at a low pressure in combination with a quantity of mercury to sustain an arc discharge during lamp operation.

According to a particular embodiment, the lamp shown in the Figure is an F34T12 ECONOWATT lamp.

Figure 2:
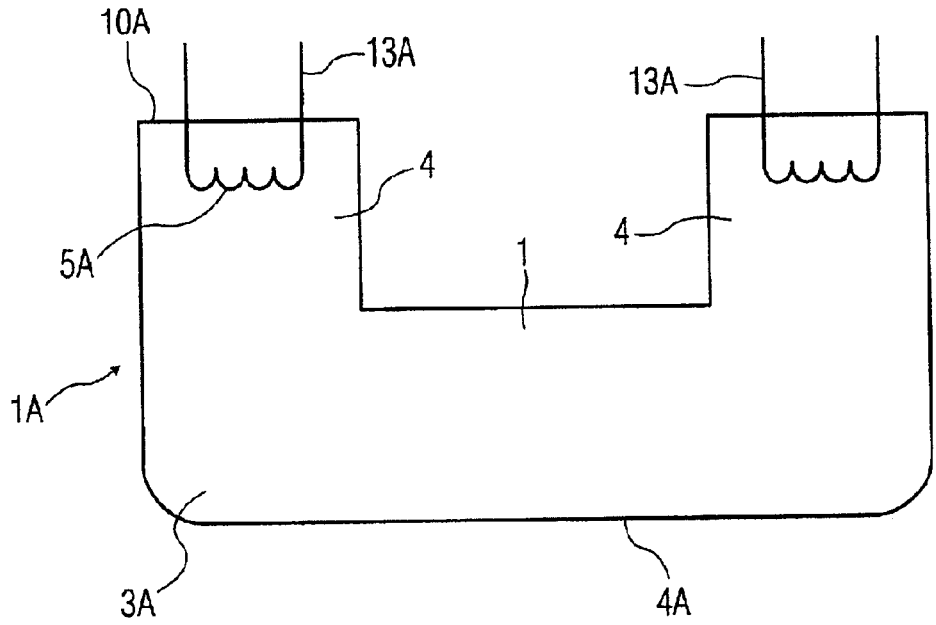
FIG. 2 is a sectional view of a U-bend fluorescent lamp according to a second embodiment of the invention.

With reference to FIG. 2, there is illustrated a schematic sectional view of a U-bent lamp unit 1A with an elongated lamp vessel, or bulb, 3A having leg segments 4 and a U-shaped section 4A. It will be understood that the envelope may take other convoluted forms and shapes and may include straight envelopes bent to a desired shape such as in PL lamps, Circleline lamps, and SLS lamps, etc.

The bulb is of a conventional soda-lime glass. The lamp includes an electrode mount structure 5A ending in a mount stem 10A of a conventional lead-containing glass which seals the envelope in a gas tight manner. The lamp leads (not shown) are connected to the pin-shaped contacts 13A of their respective bases fixed at opposite ends of the lamp.

In the normal manufacturing process, such U-bent lamps do not have pre-coats as indicated at 16 except that in the case of SLS lamps a flexible pre-coat of strontium, yttrium acetate may be used as the layer 16.

A phosphor coating 17A is disposed over the inner surface 15 (or over the pre-coat layer 16 if present). The phosphor coating extends the full length of the bulb, completely circumferentially around the bulb inner wall. The stems are free of coating.

The discharge-sustaining filling includes an inert gas such as argon, or a mixture of argon and other gases, at a low pressure in combination with a quantity of mercury to sustain an arc discharge during lamp operation.

According to a particular embodiment, the sectional view shown in the Figure is a segment of a T12TLU fluorescent lamp although it may also be a PL, Circleline, or SLS fluorescent lamp.

EXAMPLE

A. Conventional cool-white TLU U-bent fluorescent lamps were manufactured from a phosphor blend comprising 50% cool-white calcium halophosphate phosphor fines and 50% large-particle cool-white calcium halophosphate phosphor. Such lamps conventionally require about 15–40 mg of mercury to obtain acceptable life. TLU U-bent lamps comprising a phosphor blend of this invention were manufactured by the method and ingredients identical with that used to produce the conventional lamps except that the phosphor was substituted to consist of the phosphor blend of this invention and the mercury dose was adjusted. Such lamps were determined to require only about 3–5 mg of mercury to obtain the desired life in a T12TLU 34-watt lamp and, in addition were found to have a life of 18,000 to 20,000 hours. Such lamps are thus superior to conventional cool-white U-bend lamps and provide a comparable alternative to Philips cool-white low mercury lamps.

B. A T12TLU lamp was manufactured according to the invention employing about 4.4 mg of mercury and a phosphor coating of a mixture of about 18% blue-halo calcium halophosphate phosphor having an average particle size of about 8.6, about 41% calcium-yellow calcium halophosphate phosphor having an average particle size of about 11.3, and about 41% fines of warm-white calcium halophosphate phosphor having an average particle size of about 4.6. Based on historical data in our laboratories, the maximum mercury consumption (bound mercury) at 2500 hours to meet a rated life at 18,000 hours should not exceed 1.24 mg. After 2500 operating hours, the total amount of bound mercury in lamps derived from the above phosphor blend of the invention was determined to be 1.08 mg.

Table I illustrates the particle size distribution ranges of phosphors of this invention and Table II illustrates the actual particle size distribution ranges used in preferred embodiments of the invention.

TABLE I

| | Particle Size Distribution (in microns) | | |
|---|---|---|---|
| Phosphor Type | d (10%) | d (50%) | d (90%) |
| Small Particle Blue Halo | ≧2.5 | 6.6–10.0 | ≦16.9 |
| Warm white fines | Not available | | |
| Calcium YelIow | 2.5–5.5 | 9.0–13.0 | 19.0–27.0 |

TABLE II

| | Particle Size Distribution (in microns) | | |
|---|---|---|---|
| Phosphor Type | d (10%) | d (50%) | d (90%) |
| Small Particle Blue Halo | 4.56 | 8.61 | 14.51 |
| Warm white fines | 1.12 | 4.62 | 9.77 |
| Calcium Yellow | 5.90 | 11.31 | 19.17 |

In addition, the lamps pass the TCLP test and are considered non-hazardous and may be disposed in landfills.

It will be understood that the invention may be embodied in other specific forms without departing from the spirit and scope or essential characteristics thereof, the present disclosed examples being only preferred embodiments thereof.

We claim:

1. A lamp which comprises:

a lamp envelope having an inner surface;

means within the lamp envelope for generating ultraviolet radiation; and a layer of a luminescent material on said inner surface comprising a phosphor derived from a mixture of (1) a blue-halo calcium halophosphate phosphor having an average particle size within the range of about 6.6 to about 10 microns;

(2) a calcium-yellow calcium halophosphate phosphor having an average particle size within the range of about 9.0 to about 13 microns; and (3) fines of a warm-white calcium halophosphate phosphor.

2. A lamp as claimed in claim 1, wherein said blue-halo phosphor has an average particle size of about 8.60 microns.

3. A lamp as claimed in claim 1, wherein said calcium-yellow calcium halophosphate phosphor has an average particle size of about 11.3 microns.

4. A lamp as claimed in claim 1, wherein said warm white fines have an average particle size of about 4.62 microns.

5. A low pressure low-mercury consumption mercury vapor fluorescent lamp, comprising:

a. a tubular, light transmissive lamp envelope having opposing sealed ends, an inner tubular surface and enclosing a discharge space between said sealed ends with a volume;

b. a filling of elemental mercury and a rare gas;

c. a pair of discharge electrodes each arranged at a respective sealed end of said lamp envelope;

d. means for connecting said discharge electrodes to a source of electric potential outside of said lamp envelope, whereby during lamp operation a gas discharge is maintained between said discharge electrodes, which gas discharge emits ultraviolet radiation;

e. optionally, a first, light transmissive and ultraviolet radiation reflecting layer disposed adjacent said inner surface of said lamp envelope, f. a layer of a luminescent material comprising a phosphor derived from a mixture of (1) a blue-halo calcium halophosphate phosphor having an average particle size within the range of about 6.6 to about 10 microns;

(2) a calcium-yellow calcium halophosphate phosphor having an average particle size within the range of about 9.0 to about 13 microns; and (3) fines of a warm-white calcium halophosphate phosphor, said phosphor mixture providing a cool-white color to the lamp, and said lamp being TCLP-compliant.

6. A lamp as claimed in claim 5, wherein said envelope is convoluted and is selected from the group of envelopes comprising at least two leg segments joined by a bent-U section, and envelopes bent to a desired shape.

7. A lamp as claimed in claim 6, wherein said blue halo phosphor has. an average particle size of about 8.60 microns.

8. A lamp as claimed in claim 6, wherein said calcium-yellow calcium halophosphate phosphor has an average particle size of about 11.3 microns.

9. A lamp as claimed in claim 6, wherein said warm white fines have an average particle size of about 4.62 microns.

10. A low-mercury consumption mercury vapor fluorescent lamp, comprising:

a. a tubular, light transmissive lamp envelope having opposing sealed ends, an inner tubular surface and enclosing a discharge space between said sealed ends with a volume;

b. a filling of elemental mercury and a rare gas;

c. a pair of discharge electrodes each arranged at a respective sealed end of said lamp envelope;

d. means for connecting said discharge electrodes to a source of electric potential outside of said lamp envelope, whereby during lamp operation a gas discharge is maintained between said discharge electrodes, which gas discharge emits ultraviolet radiation;

e. optionally, a first, light transmissive and ultraviolet radiation reflecting layer disposed adjacent said inner surface of said lamp envelope;

f. a layer of a luminescent material comprising a phosphor derived from a mixture of (1) about 18% by weight of a blue-halo calcium halophosphate phosphor having an average particle size within the range of about 6.6 to about 10 microns;

(2) about 41% by weight of a calcium-yellow calcium halophosphate phosphor having an average particle size within the range of about 9.0 to about 13 microns; and (3) about 41% by weight of fines of a warm-white calcium halophosphate phosphor, said phosphor mixture providing a cool-white color to the lamp.

11. A lamp as claimed in claim 10, wherein said envelope is convoluted and is selected from the group of envelopes comprising at least two leg segments joined by a bent-U section, and envelopes bent to a desired shape.

12. A lamp as claimed in claim 11, wherein said envelope comprises at least two leg segments joined by a bent-U section, and said blue halo phosphor has an average particle size of about 8.60 microns.

13. A lamp as claimed in claim 12, wherein said calcium-yellow calcium halophosphate phosphor has an average particle size of about 11.3 microns.

14. A lamp as claimed in claim 13, wherein said warm white fines have an average particle size of about 4.62 microns.

15. A phosphor blend which comprises:

(1) a blue-halo calcium halophosphate phosphor having an average particle size within the range of about 6.6 to about 10 microns;

(2) a calcium-yellow calcium halophosphate phosphor having an average particle size within the range of about 9.0 to about 13 microns; and (3) fines of a warm-white calcium halophosphate phosphor, said phosphor blend when incorporated as a layer of a luminescent material on an inner surface of a lamp being effective to lower mercury consumption in the lamp without substantial reduction of the lamp life.

16. A phosphor blend as claimed in claim 15, wherein said blue-halo phosphor has an average particle size of about 8.60 microns.

17. A phosphor blend as claimed in claim 15, wherein said calcium-yellow calcium halophosphate phosphor has an average particle size of about 11.3 microns.

18. A lamp as claimed in claim 15, wherein said warm white fines have an average particle size of about 4.62 microns.

19. A phosphor blend for low-mercury consumption fluorescent lamps which comprises:

(1) about 18% by weight of a blue-halo calcium halophosphate phosphor having an average particle size within the range of about 6.6 to about 10 microns;

(2) about 41% by weight of a calcium-yellow calcium halophosphate phosphor having an average particle size within the range of about 9.0 to about 13 microns; and (3) about 41% by weight of fines of a warm-white calcium halophosphate phosphor, said phosphor blend when incorporated as a layer of a luminescent material on an inner surface of a fluorescent lamp being effective to lower mercury consumption in the lamp without substantial reduction in the lamp life.

* * * * *

UNITED STATES PATENT AND TRADEMARK OFFICE

CERTIFICATE OF CORRECTION

PATENT NO. : 6,781,302 B2
DATED : August 24, 2004
INVENTOR(S) : Sigai et al.

It is certified that error appears in the above-identified patent and that said Letters Patent is hereby corrected as shown below:

Title page,
Item [75], Inventors, change "Gary A. Sigai" to -- A. Gary Sigai --.

Signed and Sealed this

Twenty-first Day of December, 2004

JON W. DUDAS
*Director of the United States Patent and Trademark Office*